US007799502B2

(12) United States Patent
Patel et al.

(10) Patent No.: US 7,799,502 B2
(45) Date of Patent: Sep. 21, 2010

(54) TONER PROCESSES

(75) Inventors: Raj Patel, Oakville (CA); Mike Hawkins, Cambridge (CA); Paul Gerroir, Oakville (CA); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 954 days.

(21) Appl. No.: 11/094,404

(22) Filed: Mar. 31, 2005

(65) Prior Publication Data

US 2006/0222996 A1 Oct. 5, 2006

(51) Int. Cl.
*G03G 9/08* (2006.01)

(52) U.S. Cl. ..... 430/137.11; 430/137.14; 523/335; 523/352; 523/201; 523/203; 523/210; 523/160; 523/161

(58) Field of Classification Search ..... 430/137.11, 430/137.14; 523/335, 352, 201, 206, 207, 523/210, 160, 161
See application file for complete search history.

(56) References Cited

U.S. PATENT DOCUMENTS 3,944,493 A 3/1976 Jadwin et al.
4,007,293 A 2/1977 Mincer et al.
4,079,014 A 3/1978 Burness et al.
4,298,672 A 11/1981 Lu
4,394,430 A 7/1983 Jadwin et al.
4,464,452 A 8/1984 Gruber et al.
4,480,021 A 10/1984 Lu et al.
4,560,635 A 12/1985 Hoffend et al.
4,788,123 A 11/1988 Berkes et al.
4,828,956 A 5/1989 Creatura et al.
4,894,308 A 1/1990 Mahabadi et al.
4,937,157 A 6/1990 Haack et al.
4,948,686 A 8/1990 Koch et al.
4,963,455 A 10/1990 Laing et al.
4,965,158 A 10/1990 Gruber et al.
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,376,172 A 12/1994 Tripp et al.
5,403,693 A 4/1995 Patel et al.
5,405,728 A 4/1995 Hopper et al.
5,418,108 A 5/1995 Kmiecik-Lawrynowicz et al.
5,482,812 A 1/1996 Hopper et al.
5,496,676 A 3/1996 Croucher et al.
5,501,935 A 3/1996 Patel et al.
5,527,658 A 6/1996 Hopper et al.
5,585,215 A 12/1996 Ong et al.
5,593,807 A 1/1997 Sacripante et al.
5,604,076 A 2/1997 Patel et al.
5,622,806 A 4/1997 Veregin et al.
5,648,193 A 7/1997 Patel et al.
5,650,255 A 7/1997 Ng et al.
5,650,256 A 7/1997 Veregin et al.
5,658,704 A 8/1997 Patel et al.
5,660,965 A 8/1997 Mychajlowskij et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajilowskij et al.
5,916,725 A 6/1999 Patel et al.
5,919,595 A 7/1999 Mychajilowskij et al.
5,922,501 A 7/1999 Cheng et al.
5,925,488 A 7/1999 Patel et al.
5,945,245 A 8/1999 Mychajilowskij et al.
5,977,210 A 11/1999 Patel et al.
5,994,020 A 11/1999 Patel et al.
6,004,714 A 12/1999 Ciccarelli et al.
6,017,671 A 1/2000 Sacripante et al.
6,020,101 A 2/2000 Sacripante et al.
6,045,240 A 4/2000 Hochstein
6,132,924 A 10/2000 Patel et al.
6,143,457 A 11/2000 Carlini et al.
6,190,815 B1 2/2001 Ciccarelli et al.
6,210,853 B1 4/2001 Patel et al.
6,214,507 B1 4/2001 Sokol et al.
6,268,102 B1 7/2001 Hopper et al.
6,495,302 B1 12/2002 Jiang et al.
6,500,597 B1 12/2002 Patel et al.
6,541,175 B1 4/2003 Jiang et al.

(Continued)

*Primary Examiner*—Mark F Huff
*Assistant Examiner*—Rachel L Burney
(74) *Attorney, Agent, or Firm*—MH2 Technology Law Group LLP

(57) ABSTRACT

A process including mixing a sulfonated polyester resin, a colorant, and a coagulant; heating the resulting sulfonated polyester mixture; adding a polymetal halide and an anionic latex to form coated toner particles; and heating the coated toner particles is disclosed.

27 Claims, No Drawings

U.S. PATENT DOCUMENTS 6,638,677 B2 10/2003 Patel et al.
6,673,500 B1 * 1/2004 Patel et al. ..... 430/108.2
6,673,505 B2 1/2004 Jiang et al.
6,756,176 B2 * 6/2004 Stegamat et al. ..... 430/137.14
2003/0073024 A1 4/2003 Vanbesien et al.
2003/0165767 A1 9/2003 Patel et al.
2004/0241568 A1 * 12/2004 Farrugia et al. ..... 430/137.14
2004/0265728 A1 * 12/2004 Patel et al. ..... 430/137.1
2006/0222990 A1 * 10/2006 Farrugia et al. ..... 430/109.4

* cited by examiner

TONER PROCESSES

FIELD

The present disclosure relates to toner processes.

REFERENCES

Sulfonated polyester (SPE) toner particles are known and have been surface treated with many types of materials and, in certain cases, have shown triboelectric improvement. These surface treatments may be difficult to reproduce and may not be practical to scale up. The primary drawback to reproducibility is that for any surface treatment to succeed, the colloidal properties of the particles have to be well characterized out of all the groups that are present on the surface of the toner particles. Furthermore, surface treatments become more reproducible and scalable as the particle size increases to, for example, 50 microns and above. In the case of SPE particles, there is an abundance of the coagulating metal salt such as zinc acetate in the aqueous phase. This in turn further aggregates/coalesces the toner size particles during surface treatments, thereby increasing the particle size in an uncontrollable manner. It has been calculated that only about $1/6^{th}$ of the zinc acetate is in the toner particles, while the rest is in the aqueous phase. Therefore, it may be valuable to wash the toner particles a few times to remove the excess zinc acetate, thereby also cleaning the surface of the toner particles and hence removing unknown entities from the surface. Regardless of the amount of zinc acetate present, the target particle size for the SPE toners may be from about 3 to about 15 microns. Each can be a factor in the general batch-to-batch reproducibility.

Of interest may be U.S. Pat. Nos. 6,132,924; 6,268,102; and 5,994,020.

As discussed above, surface treatments while being somewhat successful at the bench level are difficult to scale up, e.g. volume of toner. External additives have partially helped, but as soon as the additives fall off of the toner particles, the development becomes an issue. Thus, there is a need to render the surface of the toner particles less sensitive to moisture and to prepare the particles in a large scale without affecting development.

RELATED APLICATIONS AND PATENTS

Illustrated in U.S. Pat. No. 6,638,677, the disclosure of which is totally incorporated herein by reference, is a process comprising heating a latex, a colorant dispersion, a polytetrafluoroethylene dispersion, and an organo metallic complexing component.

Illustrated in U.S. Pat. No. 6,673,505, the disclosure of which is totally incorporated herein by reference, is a process for the preparation of toner comprising (i) generating or providing a latex emulsion containing resin, water, and an ionic surfactant, and generating or providing a colorant dispersion containing colorant, water, and an ionic surfactant, or a nonionic surfactant; (ii) blending the latex emulsion with the colorant dispersion; (iii) adding to the resulting blend a coagulant of a polyamine salt of an acid wherein the salt is of an opposite charge polarity to that of the surfactant latex; (iv) heating the resulting mixture below or about equal to the glass transition temperature (Tg) of the latex resin; (v) optionally adding a second latex comprised of resin particles suspended in an aqueous phase resulting in a shell; (vi) adjusting with a base the pH to about 7 to about 9; (vii) heating the resulting mixture of (vi) above about the Tg of the latex resin; (viii) retaining the heating until the fusion or coalescence of resin and colorant is initiated; (ix) changing the pH of the above (viii) mixture with an acid to arrive at a pH of about 1.5 to about 3.5 to thereby accelerate the fusion or the coalescence and resulting in toner particles comprised of resin, and colorant.

Illustrated in U.S. Pat. No. 6,541,175, the disclosure of which is totally incorporated herein by reference, is a process comprising: (i) providing or generating an emulsion latex comprised of sodium sulfonated polyester resin particles by heating the particles in water at a temperature of from about 65° C. to about 90° C.; (ii) adding with shearing to the latex (i) a colorant dispersion comprising from about 20 percent to about 50 percent of a predispersed colorant in water, followed by the addition of an organic or an inorganic acid; (iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Illustrated in U.S. Pat. No. 6,495,302, the disclosure of which is totally incorporated herein by reference, is a process for the preparation of toner comprising (i) generating a latex emulsion of resin, water, and an ionic surfactant, and a colorant dispersion of a colorant, water, an ionic surfactant, or a nonionic surfactant, and wherein (ii) the latex emulsion is blended with the colorant dispersion; (iii) adding to the resulting blend containing the latex and colorant a coagulant of a polyaluminum chloride with an opposite charge to that of the ionic surfactant latex colorant; (iv) heating the resulting mixture below or equal to about the glass transition temperature (Tg) of the latex resin to form aggregates; (v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates; (vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9; (vii) heating the resulting aggregate suspension of (vi) above about the Tg of the latex resin; (viii) optionally retaining the mixture (vii) at a temperature of from about 70° C. to about 95° C.; (ix) changing the pH of the (viii) mixture by the addition of an acid to arrive at a pH of about 1.7 to about 4; and (x) optionally isolating the toner.

Illustrated in U.S. Pat. No. 6,500,597, the disclosure of which is totally incorporated herein by reference, is a process comprising (i) blending a colorant dispersion of a colorant, water, and an anionic surfactant, or a nonionic surfactant with (ii) a latex emulsion comprised of resin, water, and an ionic surfactant; (iii) adding to the resulting blend a first coagulant of polyaluminum sulfosilicate (PASS) and a second cationic co-coagulant having an opposite charge polarity to that of the latex surfactant; (iv) heating the resulting mixture below about the glass transition temperature (Tg) of the latex resin; (v) adjusting with a base the pH of the resulting toner aggregate mixture from a pH which is in the range of about 1.8 to about 3 to a pH range of about 5 to about 9; (vi) heating above about the Tg of the latex resin; (vii) changing the pH of the mixture by the addition of a metal salt to arrive at a pH of from about 2.8 to about 5; and (viii) optionally isolating the product.

SUMMARY

Various aspects of the present disclosure relate to a process comprising mixing a sulfonated polyester resin, a colorant, and a coagulant; heating the resulting sulfonated polyester mixture; adding a polymetal halide and an anionic latex to form coated toner particles; and heating the coated toner particles; a process comprising mixing a colorant, a sulfonated polyester resin, and a coagulant to form toner particles having a particle size of from about 1 to about 5 microns; heating the resulting sulfonated polyester toner particles; adding a polymetal halide and an anionic latex comprising a vinyl polymer resin; and fusing the vinyl polymer resin to a surface of the toner particles by heating; a process comprising mixing a sulfonated polyester toner particle with a coagulant to form a core toner particle; and adding a polymetal halide onto a surface of the core toner particle to form a coated toner particle; a process comprising mixing a sulfonated polyester resin, a colorant, and a first portion of a coagulant; heating the mixture; and adding a second portion of the coagulant to form sulfonated polyester toner particles; and a process comprising mixing a sulfonated polyester resin, a colorant, a wax and a coagulant; heating the resulting sulfonated polyester toner particles; adding a polymetal halide and an anionic latex to form coated toner particles; and heating the coated toner particles.

DESCRIPTION OF VARIOUS EMBODIMENTS

Various aspects of the present disclosure relate to a process comprising mixing a sulfonated polyester resin, a colorant, and a coagulant thereby forming core sulfonated polyester toner particles. The core toner particles may then be heated. The disclosed process further comprises adding a polymetal halide and an anionic latex to form coated toner particles which may then be heated.

In embodiments, the process relates to the in-situ preparation of a core toner particle comprising a polyester resin, such as a sulfonated polyester resin, with a shell comprising a vinyl polymer, such as styrene acrylate carboxylic acid. Because the polyester resin may comprise sulfonation groups, it may be readily dispersible in water, such as at 70° C., and may result in submicron particles. Moreover, because, for example, a sulfonated polyester resin is a water borne resin, toners resulting from it may be moisture sensitive.

The colorant for use in the disclosed process may be present in a colorant dispersion comprising a colorant, water, and a surfactant, such as an ionic and/or a nonionic surfactant. The colorant may be selected from the group consisting of dyes and pigments, such as those disclosed in U.S. Pat. Nos. 4,788,123; 4,828,956; 4,894,308; 4,948,686; 4,963,455; and 4,965,158, the disclosures of all of which are hereby incorporated by reference. Non-limiting examples of the pigment include black, cyan, magenta, yellow, green, orange, brown, violet, blue, red, purple, white, and silver. Non-limiting examples of the colorant include carbon black (for example, REGAL 330®), Flexiverse Pigment BFD1121, nigrosine dye, aniline blue, magnetites and colored magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; phthalocyanines, 2,9-dimethyl-substituted quinacridone and anthraquinone dyes identified in the Color Index as CI 60710, CI Dispersed Red 15, diazo dyes identified in the Color Index as CI26050, CI Solvent Red 19, copper tetra (octadecyl sulfonamide) phthalocyanine, x-copper phthalocyanine pigment listed in the Color Index as CI 74160, CI Pigment Blue, Anthradanthrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, cyan components, and the like, as well as mixtures thereof. Other commercial sources of pigments available as aqueous pigment dispersion from either Sun Chemical or Ciba include, but are not limited to, Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Other suitable colorants include, but are not limited to, Cinquasia Magenta (DuPont), Levanyl Black A-SF (Miles, Bayer), Sunsperse Carbon Black LHD 9303, Sunsperse Blue BHD 6000 and Sunsperse Yellow YHD 6001 available from Sun Chemicals; Normandy Magenta RD-2400, Permanent Yellow YE 0305, Permanent Violet VT2645, Argyle Green XP-111-S, Lithol Rubine Toner, Royal Brilliant Red RD-8192, Brilliant Green Toner GR 0991, and Ortho Orange OR 2673, all available from Paul Uhlich; Sudan Orange G, Tolidine Red, and E.D. Toluidine Red, available from Aldrich; Sudan III, Sudan II, and Sudan IV, all available from Matheson, Coleman, Bell; Scarlet for Thermoplast NSD PS PA available from Ugine Kuhlman of Canada; Bon Red C available from Dominion Color Co.; Lumogen Yellow D0790, Suco-Gelb L1250, Suco-Yellow D1355, Paliogen Violet 5100, Paliogen Orange 3040, Paliogen Yellow 152, Neopen Yellow, Paliogen Red 3871 K, Paliogen Red 3340, Paliogen Yellow 1560, Paliogen Violet 5890, Paliogen Blue 6470, Lithol Scarlet 4440, Lithol Fast Scarlet L4300, Lithol Scarlet D3700, Lithol Fast Yellow 0991 K, Paliotol Yellow 1840, Heliogen Green L8730, Heliogen Blue L6900, L7202, D6840, D7080, Neopen Blue, Sudan Blue OS, Sudan Orange 220, and Fanal Pink D4830, all available from BASF; Cinquasia Magenta available from DuPont; Novoperm Yellow FG1 available from Hoechst; Hostaperm Pink E, and PV Fast Blue B2G01 all available from American Hoechst; Irgalite Blue BCA, and Oracet Pink RF, all available from Ciba-Geigy. Mixtures of colorants can also be employed.

When present, the colorant may be present in the toner composition in any desired or effective amount, such as from about 1% to about 25% by weight of the toner composition, for example from about 2% to about 15%, and as a further example from about 5% to about 12% by weight based upon the total weight of the toner composition. The amount can, however, be outside of these ranges.

The sulfonated polyester resin may contain sulfonation ($SO_4^-$ or $SO_3^-$) groups which may be aggregated/coalesced to toner size particles under controlled conditions, in the range of about 3.5 to about 6.5 and for example the pH may be about 5.5 in the presence of a coagulant. The sulfonated polyester resin may be dispersible in warm water, such as about 70° C., and may result in submicron particles. The sulfonated polyester resin may be a polymer selected from the group consisting of sulfonated polyesters such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate ), and copoly(propoxylated bisphenol A)-copoly-(propoxylated bisphenol A-sodio 5-sulfoisophthalate). The sulfonated polyester resin may be selected from the group consisting of linear, branched, and crystalline. The size of the resin particles may be of from about 0.05 to about 1 micron.

Various diacids or esters of diacids can be chosen to form the sulfonated polyester resin of the present disclosure, such as those selected from the group consisting of fumaric acid, malonic acid, itaconic acid, 2-methylitaconic acid, maleic acid, maleic anhydride, adipic acid, succinic acid, suberic acid, 2-ethyl succinic acid, glutaric acid, dodecylsuccinic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, dialkyl esters wherein alkyl contains from about 2 to about 22 carbon atoms, and may be esters of malonate, succinate, fumarate, itaconate, terephthalate, isophthalate, phthalate, cyclohexanedioate, and mixtures thereof. The diacids may optionally be selected in an amount of from 35 mole percent to about 0.45 mole percent based on about 100 mole percent of the resin. In embodiments, the diacid may be selected from the group consisting of fumaric acid, malonic acid, itaconic acid, 2-methylitaconic acid, maleic acid, and maleic anhydride.

In embodiments, examples of sulfonated organic diacids or esters of diacids include those selected from the group consisting of sodio 5-sulfoisophthalic acid, potassio 5-sulfoisophthalic acid, sodio 2-sulfoterephthalic acid, potassio 2-sulfoterephthalic acid, dimethyl 5-sulfoisophthalate sodium salt, dimethyl 5-sulfoisophthalate potassium salt, and mixtures thereof. The diacids may be optionally present in an amount of from 1 mole percent to about 10 mole percent, based on about 100 mole percent of the resin.

Examples of organic diols which may be utilized in preparing the sulfonated polyester resin include, but are not limited to, diols or glycols, such as alkylene glycols, with a carbon chain length of, for example, from about 1 to about 25 carbon atoms, and as a further example, ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, hexylene glycol, heptalyne glycol, diethylene glycol, dipropylene glycol, cyclohexane diol, 2,2-dimethyl propane diol, 1,2-propanediol, neopentylene glycol, octylene glycol, cyclohexane dimethanol, and mixtures thereof. The organic diols, including the diols or glycols, may be employed in various effective amounts of, for example, from about 45 to about 55 mole percent of the resin.

The sulfonated polyester resin may possess a number average molecular weight (Mn) of from about 1,500 to about 50,000 grams per mole, and a weight average molecular weight (Mw) of from about 6,000 grams per mole to about 150,000 grams per mole as measured by gel permeation chromatography and using polystyrene as standards and a polydispersity of from about 2 to about 12.

The sulfonated polyester resin may be present in a toner composition in any desired or effective amount, such as from about 75 to about 95 weight percent, for example from about 80 to about 90 weight percent, based upon the total weight of the toner composition. The amount can, however, be outside of these ranges.

A coagulant, such as a metal salt, may assist in aggregating and coalescing the sulfonated polyester resin. The coagulant may be a water soluble metal salt, such as a monovalent, divalent, or multivalent salt, selected from the group consisting of chlorides, sulfates, nitrates, bromides, iodides, fluorides, acetoacetate, sulfo-silicates, and acetates of aluminum, magnesium, zinc, sodium, lithium, rubidium, cesium, beryllium, barium, strontium, copper, manganese, chromium, iron, vanadyl, and potassium. Non-limiting examples of the coagulant include aluminum chloride, zinc sulfate, magnesium sulfate, potassium-aluminum sulfate, sodium chloride, sodium bromide, sodium iodide, sodium fluoride, sodium acetate, sodium acetoacetate, lithium chloride, lithium bromide, lithium iodide, lithium fluoride, lithium acetate, lithium acetoacetate, potassium chloride, potassium bromide, potassium iodide, potassium fluoride, acetate, potassium acetoacetate, rubidium bromide, rubidium chloride, rubidium iodide, rubidium fluoride, rubidium acetate, rubidium acetoacetate, cesium bromide, cesium chloride, cesium iodide, cesium fluoride, cesium acetate, cesium acetoacetate, beryllium bromide, beryllium chloride, beryllium iodide, beryllium fluoride, beryllium acetate, beryllium acetoacetate, magnesium bromide, magnesium chloride, magnesium iodide, magnesium fluoride, magnesium acetate, magnesium acetoacetate, calcium bromide, barium bromide, barium chloride, barium iodide, barium fluoride, barium acetate, barium acetoacetate, strontium bromide, strontium chloride, strontium iodide, strontium fluoride, strontium acetate, strontium acetoacetate, zinc bromide, zinc chloride, zinc iodide, zinc fluoride, zinc acetate, zinc acetoacetate, copper bromide, copper chloride, copper iodide, copper fluoride, copper acetate, copper acetoacetate, manganese bromide, manganese chloride, manganese iodide, manganese fluoride, manganese acetate, manganese acetoacetate, chromium bromide, chromium chloride, chromium iodide, chromium fluoride, chromium acetate, chromium acetoacetate, iron bromide, iron chloride, iron iodide, iron fluoride, iron acetate, iron acetoacetate, vanadyl bromide, vanadyl chloride, vanadyl iodide, vanadyl fluoride, vanadyl acetate, and vanadyl acetoacetate. The coagulant may be added in an acidic solution (for example, a 1 molar nitric acid solution) to the mixture, and during this addition step the viscosity of the mixture may increase.

In embodiments, the coagulant may be added in two portions. The first portion may be added at a temperature of about 20° C. to about 35° C., for example from about 23° C. to about 30° C., and as a further example from about 25° C. to about 28° C. After addition of the first portion, to ensure that the coagulant is used up the temperature may be increased to about 50° C. and the pH may be about 5.5. This increase in temperature may shift the equilibrium thereby forcing the zinc ions to be on the surface of the colored sulfonated polyester resin particle. Moreover, this increase in temperature may have a minimal impact on the growth of the particle size. The second portion of the coagulant may be added after the temperature is increased. The resultant sulfonated polyester toner particles may have a size of from about 1 to about 5 microns, and for example from about 2 to about 4 microns.

Thereafter, heat and stirring may be applied to induce aggregation and formation of the micron-sized particles. The aggregation temperature may be from about 40° C. to about 62° C., for example from about 45° C. to about 58° C. The temperature at which the aggregation is accomplished may control the size of the core toner particles.

In embodiments, the sulfonated polyester toner particles may optionally contain a wax. The wax may comprise submicron wax particles in the size range of from about 0.1 to about 0.5 micron, for example from about 0.2 to about 0.4 micron in diameter by volume. The wax may be dispersed in an ionic surfactant of the same charge polarity as an ionic surfactant present in the sulfonated polyester toner particles. Non-limiting examples of the wax include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected may possess a molecular weight (Mw) of from about 700 to about 2,500, while the commercially available polypropylenes may possess a molecular weight of from about 4,000 to about 7,000. Examples of functionalized waxes, such as amines, and amides, include, for example, AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and S C Johnson wax. The waxes may have a peak melting temperature (Tm) in the range of about 70° C. to about 110° C. and may have an onset heat of fusion in the range of about 50° C. to about 100° C.

In the disclosed process, an aggregating agent may be added to the core toner particles. The aggregating agent can be selected from the group consisting of polyaluminum sulfo silicate (PASS) and polymetal halides. In embodiments, when the pH of the toner particles is in the range of about 3 to about 6, for example in the range of about 5 to about 6, the aggregating agent may be added to the toner particles. The aggregating agent, unlike the coagulant, may adhere itself to the surface of the core toner particles. The polymetal halide may be polyaluminum chloride (PAC).

The pH of the mixture comprising the core toner particles and the polymetal halide may then be reduced from about 5.4 to, for example about 4. The polymetal halide may be either active or non-active depending on the pH because the pH drives the charge of the ions. For example, at a low pH the polymetal halide is active and induces a positive charge. As a result, the surface of the toner particles may be cationically charged. The polymetal halide may be present in any desired or effective amount, such as from about 0.1% to about 30% by weight, for example from about 10% to about 20% by weight relative to the weight of the toner composition. The amount can, however, be outside of these ranges.

The disclosed process further comprises adding an anionic latex to the mixture comprising the polymetal halide adhered to a surface of the core toner particles. The anionic latex may comprise a vinyl polymer resin particle which may be anionic. Non-limiting examples of the vinyl polymer resin include poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly(ethyl methacrylate/isoprene), poly(propyl methacrylate/isoprene), poly(butyl methacrylate/isoprene), poly (methyl acrylate/isoprene), poly(ethyl acrylate/isoprene), poly(propyl acrylate/isoprene), poly(butylacrylate-isoprene), poly(styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly(styrene/n-butyl acrylate/styrene sulfonate sodium salt/acrylic acid), and mixtures thereof.

The vinyl polymer resin particles, such as styrene acrylate emulsion aggregation particles, may contain a carboxylic acid group which can be controllably coalesced onto the surface of the toner particles. The carboxylic acid group of the vinyl polymer particle may be selected from the group consisting of acrylic acid, methacrylic acid, itaconic acid, beta carboxy ethyl acrylate, fumaric acid, maleic acid, and cinnamic acid, and wherein a carboxylic acid may be present in an amount of from about 0.1 to about 10 weight percent. The vinyl polymer particles may be present in any desired or effective amount, such as from about 10 to about 40 weight percent, for example in an amount of about 15 to about 30 weight percent relative to the toner particles to form a coating on the toner particles. The amount can, however, be outside of these ranges.

Following addition of the anionic latex, the pH of the mixture may be further reduced from about 4 to about 3.8, for example about 3.3, followed by stirring. In embodiments, the vinyl polymer resin may be adhered onto the surface of the core toner particles at a pH of less than about 3. It is believed, with out being limited to any particular theory, that if the pH is raised to, for example, about 6, then the vinyl polymer resin will not fuse onto the surface of the toner particles. Conversely, if the pH of the toner particles were reduced to suit the pH of the vinyl polymer resin particle, for example, to about 2.5, then it is believed that the aggregation/coalescence of the toner particles would be uncontrollable, for example, due to the generation of zinc ions.

The core toner particle mixture may be heated. For example, the temperature may be raised to fuse the anionic latex comprising the vinyl polymer particles onto the surface of the core toner particles thereby forming coated toner particles. The temperature may be raised to about 50° C. to about 65° C., for example from about 53° C. to about 63° C., and as a further example from about 56° C. to about 58° C.

The coated toner particles may be stirred for a period of about 5 to about 7 hours, and then may be washed. The filtrate may be clear indicating that there was no rejection. The coated toner particles may be dried, submitted for charging, and fusing.

The resultant coated toner particles may comprise a core comprising a sulfonated polyester resin and a shell comprising a vinyl polymer, such as a styrene acrylate carboxylic acid. This shell may allow the resultant coated toner particles to retain their charge.

The coated toner particles may have a particle size of from about 1 micron to about 25 microns, for example from about 2 to about 15 microns in volume average diameter. The particle size distribution (GSD) may be from about 1.1 to about 1.33, for example of from about 1.11 to about 1.28. The size and size distribution may be measured by a Coulter Counter, without the need to resort to conventional pulverization and classification methods.

In embodiments, a surfactant, such as an anionic and/or a nonionic surfactant may optionally be added. The surfactant may control the particle size and the particle size distribution (GSD). Examples of an ionic surfactant include, but are not limited to, anionic surfactants, such as sodium dodecylsulfate, sodium dodecylbenzene sulfonate, sodium dodecylnaphthalenesulfate, dialkyl benzenealkyl sulfates and sulfonates, abitic acid, NEOGEN R®, and NEOGEN SC® available from Kao, DOWFAX® available from Dow Chemical Co., and the like, as well as mixtures thereof. Anionic surfactants can be employed in any desired or effective amount, such as from about 0.01% to about 10% by weight of monomers used to prepare the copolymer resin, for example from about 0.1% to about 5%, although the amount can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520® IGEPAL CA-720®, IGEPAL CO-890®, IGEPAL CO-720®, IGEPAL CO-290®, ANTAROX 890®, and ANTAROX 897®), and the like, as well as mixtures thereof. The nonionic surfactant can be present in any desired or effective amount, for example, from about 0.01% to about 10% by weight of monomers used to prepare the copolymer resin, and as a further example, from about 0.1% to about 5%, although the amount can be outside of these ranges.

The toner composition optionally can also comprise a charge control additive, such as alkyl pyridinium halides, including cetyl pyridinium chloride and others as disclosed in U.S. Pat. No. 4,298,672, the disclosure of which is hereby incorporated by reference, sulfates and bisulfates, including distearyl dimethyl ammonium methyl sulfate as disclosed in U.S. Pat. No. 4,560,635, the disclosure of which is hereby incorporated by reference, and distearyl dimethyl ammonium bisulfate as disclosed in U.S. Pat. Nos. 4,937,157; 4,560,635, and application Ser. No. 07/396,497, abandoned, the disclosures of all of which are hereby incorporated by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated by reference, aluminum 3,5-di-tert-butyl salicylate compounds such as Bontron E-88, available from Orient Chemical Company of Japan, or aluminum compounds as disclosed in U.S. Pat. No. 4,845,003, the disclosure of which is hereby incorporated by reference, charge control additives as disclosed in U.S. Pat. Nos., 3,944,493; 4,007,293; 4,079,014; 4,394,430; 4,464,452; 4,480,021; and 4,560,635, the disclosures of all of which are hereby incorporated by reference, and the like, as well as mixtures thereof.

The optional charge control additive may be present in the toner composition in any desired or effective amount, such as from about 0.1% to about 10% by weight, for example from about 1% to about 5% by weight with respect to the total weight of the toner composition. The amount can, however, be outside this range.

The toner composition may also optionally comprise an external surface additive, including flow aid additives, which additives may be usually present on the toner surface thereof. Non-limiting examples of the external surface additive include metal oxides like titanium oxide, tin oxide, mixtures thereof, and the like, colloidal silicas, such as AEROSIL®, metal salts and metal salts of fatty acids inclusive of zinc stearate, aluminum oxides, cerium oxides, and mixtures thereof. Several of the aforementioned additives are illustrated in U.S. Pat. Nos. 3,590,000 and 3,800,588, the disclosures of which are totally incorporated herein by reference. Moreover, the external surface additive may be a coated silica of U.S. Pat. Nos. 6,004,714; 6,190,815 and 6,214,507, the disclosures of which are totally incorporated herein by reference. The external surface additive can be added during the aggregation process or blended onto the formed toner particles.

The optional external surface additive may be present in any desired or effective amount, for example, of from about 0.1% to about 5% by weight, as a further example from about 0.1% to about 1% by weight with respect to the total weight of the toner composition. The amount can, however, be outside this range.

The coalesced particles differ from the uncoalesced aggregates primarily in morphology; the uncoalesced particles have greater surface area, such as having a "grape cluster" shape, whereas the coalesced particles are reduced in surface area, such as having a "potato" shape or even a spherical shape. The particle morphology can be controlled by adjusting conditions during the coalescing process, such as temperature, coalescence time, and the like.

Emulsion aggregation processes suitable for making the disclosed toner particles are illustrated in a number of patents, the disclosures of which are totally incorporated herein by reference, such as U.S. Pat. Nos. 5,278,020; 5,290,654; 5,308,734; 5,344,738; 5,346,797; 5,348,832; 5,364,729; 5,366,841; 5,370,963; 5,376,172; 5,403,693; 5,418,108; 5,405,728; 5,482,812; 5,496,676; 5,501,935; 5,527,658; 5,585,215; 5,593,807; 5,604,076; 5,622,806; 5,648,193; 5,650,255; 5,650,256; 5,658,704; 5,660,965; 5,723,253; 5,744,520; 5,763,133; 5,766,818; 5,747,215; 5,804,349; 5,827,633; 5,853,944; 5,840,462; 5,863,698; 5,869,215; 5,902,710; 5,910,387; 5,916,725; 5,919,595; 5,922,501; 5,925,488; 5,945,245; 5,977,210; 6,017,671; 6,020,101; 6,045,240; 6,132,924; 6,143,457; and 6,210,853. The components and processes of the patents can be selected for the present disclosure in embodiments thereof.

EXAMPLES

The following examples are illustrative and are non-limiting to the present teachings.

Example 1

Sulfonated Polyesteremulsion (A): (SPE)

Sulfonated polyester resin containing 3.75 moles of sulfonation was prepared by polycondensation reaction. The resin was ground into powder by milling. 100 gm of the resin powder was added to 10 liters of water in a reactor and stirred at a speed of 500 rpm with a pitch blade turbine. The temperature of the reactor was raised to 85° C. and allowed to stir for a period of 1 hour in order to dissipate the resin into an emulsion comprising about 25 nm sulfonated polyester (SPE) resin particles suspended in water. The reactor was then cooled down to about 23° C. to about 25° C. and the emulsion discharged. The emulsion comprised 11 weight percent resin and 89 weight percent water.

Preparation of Vinyl Polymeric Emulsion B:

A latex emulsion comprising polymer particles generated by the emulsion polymerization of styrene butyl acrylate and beta carboxy ethyl acrylate (beta CEA) was prepared as follows. A surfactant solution of 28.9 grams of DOWFAX 2A1™ (anionic emulsifier—55% active ingredients) and 25.8 kg of de-ionized water was prepared by mixing for 5 mins. in a stainless steel holding tank. The holding tank was then purged with nitrogen for 5 minutes before transferring the mixture into a reactor. The reactor was then continuously purged with nitrogen while being stirred at 100 rpm. The reactor was then heated to 80° C.

Separately, 407 g of ammonium persulfate initiator were dissolved in 2.0 kg of de-ionized water. Also, separately a monomer emulsion A was prepared in the following manner. 21 kg of styrene, 6.11 kg of DOWFAX™ (anionic surfactant), and 12.9 kg of de-ionized water were mixed to form an emulsion. Five percent of the above emulsion was then slowly fed into the reactor containing the aqueous surfactant phase at 80° C. to form the seeds wherein the "seeds" refer, for example, to the initial emulsion latex added to the reactor prior to the addition of the initiator solution, while being purged with nitrogen. The above initiator solution was then slowly charged into the reactor, forming about 5 to about 12 nm of latex "seed" particles. After 10 minutes, the remainder of the emulsion was continuously fed in using metering pumps.

Once all of the above monomer emulsion was charged into the main reactor, the temperature was maintained at 80° C. for an additional 2 hours to complete the reaction. The reactor contents were then cooled down to about 25° C. The resulting isolated product comprised 40 weight percent of sub-micron, 0.2 micron diameter resin particles of styrene/butylacrylate/betaCEA suspended in an aqueous phase containing the above surfactant. The molecular properties resulting for the resin latex were Mw of 36,000, Mn of 10.8, as measured by gel permeation chromatography, and a midpoint Tg of 53.8° C., as measured by differential scanning calorimeter, where the midpoint Tg is defined as the halfway point between the onset and the offset Tg of the polymer.

Toner Preparation 400 g of the above SPE emulsion (A) containing 11% solids was placed in a beaker to which was added 5.8 g of a flexiverse cyan pigment dispersion comprising 48% solids (38% pigment an 10% resin). This was placed on a temperature controlled hotplate and stirred with an overhead stirrer. 1.4 g of zinc acetate (ZnAc) (3% by weight of solids) was placed in 45 g of water and shaken until dissolved. This was added slowly into the mixture after which the contents were heated up to 50° C. The particle size measured was 1.7 microns with a GSD of 1.84. To this was then added another similar portion of ZnAc solution at 50° C. and allowed to stir for an additional 2 hours, resulting in a particle size of 1.9 microns with a GSD of 1.23. The pH of the mixture was found to be 5.4. To this was added 2.26 g of PAC solution containing 0.26 g PAC (10% active ingredients) and 2.0 g of 0.1 M nitric acid. The pH of the mixture was then further reduced to 4.0 with 4% nitric acid solution. The particle size was found to be 2.3 microns. To this was added 40 gm of emulsion B (40% solids) and the pH further reduced down to 3.4 to activate the PAC and stirred overnight. The particle size was now found to be 3.0 microns (FIG. 1). The temperature was then raised to 55° C. and the reactor allowed to stir for an additional 2 hrs. The particle size was found to be 3.6 microns. The reactor contents were further stirred for another 4 hours resulting in a particle size of 6.0 microns with a GSD of 1.28. A small sample was allowed to stir for another 2 hrs upon which the supematant was observed to be clear. The particle size was found to be 6.7 microns with a GSD of 1.28. The toner particles were washed and filtered twice with DIW and freeze dried. The toner had a particle shape factor of 125 as calculated from a Scanning electron micrograph. The Sysmex FPIA-2100 can also be used to calculate the circularity, which was always less or equal to 1.0.

Example 2

A second toner was prepared using the process in accordance with example 1, except that the pigment in this case was REGAL 330® Carbon Black where the carbon black loading was 6 weight percent.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "a resin" includes two or more different resins. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A process comprising:

mixing a sulfonated polyester resin, a colorant, and a coagulant, wherein a first portion of the coagulant is added at a temperature of about 20° C. to about 35° C.; after the first portion of the coagulant is added the temperature is increased to about 50° C. and the pH is about 5.5; and after the temperature is increased a second portion of the coagulant is added;

heating the resulting sulfonated polyester mixture;

adding an anionic latex and an aggregating agent to form coated toner particles, wherein the aggregating agent is selected from the group consisting of polyaluminum sulfosilicate and a polymetal halide; and heating the coated toner particles.

2. The process of claim 1, wherein the sulfonated polyester resin is selected from the group consisting of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene sodio 5-sulfoisophthalate)-copoly-(1,2-propylene-diethylene-terephthalate-phthal ate), copoly (ethylene-neopentylene-sodio 5-sulfoisophthalate)-copoly-(ethylene-neopentylene-terephthalate-phthalate), copoly (propoxylated bisphenol A)-copoly-(propoxylated bisphenol A-sodio 5-sulfoisophthalate), crystalline sulfonated polyester resin, and branched sulfonated polyester resin.

3. The process of claim 1, wherein the colorant is selected from the group consisting of dyes, pigments, and mixtures thereof.

4. The process of claim 1, wherein the coagulant is selected from the group consisting of aluminum chloride, zinc sulfate, magnesium sulfate, potassium-aluminum sulfate, sodium chloride, sodium bromide, sodium iodide, sodium fluoride, sodium acetate, sodium acetoacetate, lithium chloride, lithium bromide, lithium iodide, lithium fluoride, lithium acetate, lithium acetoacetate, potassium chloride, potassium bromide, potassium iodide, potassium fluoride, potassium acetate, potassium acetoacetate, rubidium bromide, rubidium chloride, rubidium iodide, rubidium fluoride, rubidium acetate, rubidium acetoacetate, cesium bromide, cesium chloride, cesium iodide, cesium fluoride, cesium acetate, cesium acetoacetate, beryllium bromide, beryllium chloride, beryllium iodide, beryllium fluoride, beryllium acetate, beryllium acetoacetate, magnesium bromide, magnesium chloride, magnesium iodide, magnesium fluoride, magnesium acetate, magnesium acetoacetate, calcium bromide, barium bromide, barium chloride, barium iodide, barium fluoride, barium acetate, barium acetoacetate, strontium bromide, strontium chloride, strontium iodide, strontium fluoride, strontium acetate, strontium acetoacetate, zinc bromide, zinc chloride, zinc iodide, zinc fluoride, zinc acetate, zinc acetoacetate, copper bromide, copper chloride, copper iodide, copper fluoride, copper acetate, copper acetoacetate, manganese bromide, manganese chloride, manganese iodide, manganese fluoride, manganese acetate, manganese acetoacetate, chromium bromide, chromium chloride, chromium iodide, chromium fluoride, chromium acetate, chromium acetoacetate, iron bromide, iron chloride, iron iodide, iron fluoride, iron acetate, iron acetoacetate, vanadyl bromide, vanadyl chloride, vanadyl iodide, vanadyl fluoride, vanadyl acetate, and vanadyl acetoacetate.

5. The process of claim 1, wherein after the addition of the second portion of the coagulant the sulfonated polyester toner particles have a particle size of about 2 to about 3 microns.

6. The process of claim 1, further comprising after heating the sulfonated polyester toner particles reducing the pH to about 4.

7. The process of claim 1, wherein the aggregating agent is polyaluminum chloride.

8. The process of claim 1, wherein the anionic latex comprises a vinyl polymer resin selected from the group consisting of poly(styrene/butadiene), poly(p-methyl styrene/butadiene), poly(m-methyl styrene/butadiene), poly(α-methyl styrene/butadiene), poly(methyl methacrylate/butadiene), poly(ethyl methacrylate/butadiene), poly(propyl methacrylate/butadiene), poly(butyl methacrylate/butadiene), poly(methyl acrylate/butadiene), poly(ethyl acrylate/butadiene), poly(propyl acrylate/butadiene), poly(butyl acrylate/butadiene), poly(styrene/isoprene), poly(p-methyl styrene/isoprene), poly(m-methyl styrene/isoprene), poly(α-methyl styrene/isoprene), poly(methyl methacrylate/isoprene), poly (ethyl methacrylate/isoprene), poly(propyl methacrylate/isoprene), poly(butyl methacrylate/isoprene), poly(methyl acrylate/isoprene), poly(ethyl acrylate/isoprene), poly(propyl acrylate/isoprene), poly(butylacrylate-isoprene), poly (styrene/n-butyl acrylate/acrylic acid), poly(styrene/n-butyl methacrylate/acrylic acid), poly(styrene/n-butyl methacrylate/β-carboxyethyl acrylate), poly(styrene/n-butyl acrylate/β-carboxyethyl acrylate) poly(styrene/butadiene/methacrylic acid), poly(styrene/n-butyl acrylate/styrene sulfonate sodium salt/acrylic acid), and mixtures thereof.

9. The process of claim 1, wherein the coated toner particles are negatively charged.

10. The process of claim 1, wherein the first heating is below the Tg of the sulfonated polyester resin and the second heating is above the Tg of the sulfonated polyester resin.

11. The process of claim 1, wherein the coated toner particles are heated to a temperature of about 50° C. to about 65° C.

12. The process of claim 1, wherein the heating of the coated toner particles fuses the anionic latex onto a surface of the toner particles.

13. The process of claim 1, wherein the colorant is a cyan pigment and wherein the anionic latex comprises styrene acrylate carboxylic acid.

14. A process comprising:

mixing a colorant, a sulfonated polyester resin, and a coagulant to form toner particles having a particle size of from about 1 to about 5 microns, wherein a first portion of the coagulant is added at a temperature of about 20° C. to about 35° C.; after the first portion of the coagulant is added the temperature is increased to about 50° C. and the pH is about 5.5; and after the temperature is increased a second portion of the coagulant is added;

heating the resulting sulfonated polyester toner particles;

adding an aggregating agent and an anionic latex comprising a vinyl polymer resin, wherein the aggregating agent is selected from the group consisting of polyaluminum sulfosilicate and a polymetal halide; and fusing the vinyl polymer resin to a surface of the toner particles by heating.

15. The process of claim 14, wherein the coagulant is zinc acetate and the vinyl polymer resin is styrene acrylate carboxylic acid.

16. A process comprising:

mixing a sulfonated polyester toner particle with a coagulant to form a core toner particle, wherein a first portion of the coagulant is added at a temperature of about 20° C. to about 35° C.; after the first portion of the coagulant is added the temperature is increased to about 50° C. and the pH is about 5.5; and after the temperature is increased a second portion of the coagulant is added; and adding an aggregating agent onto a surface of the core toner particle to form a coated toner particle, wherein the aggregating agent is selected from the group consisting of polyaluminum sulfosilicate and a polymetal halide.

17. The process of claim 16, wherein the sulfonated polyester toner particle has a particle size of from about 25 to about 100 nm.

18. The process of claim 16, wherein the core toner particle has a particle size of from about 3 to about 4 microns.

19. A process comprising:

mixing a sulfonated polyester resin, a colorant, and a first portion of a coagulant at a temperature of about 20° C. to about 35° C.;

heating the mixture to an increased temperature of about 50° C., wherein the pH is about 5.5; and after increasing the temperature, adding a second portion of the coagulant to form sulfonated polyester toner particles.

20. The process of claim 19, wherein an initial temperature of the mixture is about 23° C. to about 25° C.

21. The process of claim 19, wherein the initial pH of the mixture is 5.5.

22. The process of claim 19, wherein the sulfonated polyester toner particles have a particle size of from about 2 to about 3 microns.

23. A process comprising:

mixing a sulfonated polyester resin, a colorant, a wax and a coagulant, wherein a first portion of the coagulant is added at a temperature of about 20° C. to about 35° C.; after the first portion of the coagulant is added the temperature is increased to about 50° C. and the pH is about 5.5; and after the temperature is increased a second portion of the coagulant is added;

heating the resulting sulfonated polyester toner particles;

adding an aggregating agent and an anionic latex to form coated toner particles wherein the aggregating agent is selected from the group consisting of polyaluminum sulfosilicate and a polymetal halide; and heating the coated toner particles.

24. The process of claim 23, wherein the polymetal halide is added to the toner particles at a pH of about 5.4.

25. The process of claim 23, wherein the polymetal halide is present in an amount of from about 0.1% to about 10% by weight relative to the weight of the sulfonated polyester toner particles.

26. The process of claim 23, further comprising reducing the pH of the coated toner particles to about 4 after the polymetal halide is added.

27. The process of claim 23, further comprising reducing the pH of the coated toner particles to less than about 3 after the anionic latex is added.

* * * * *